United States Patent [19]

Meisel, Jr.

BEST AVAILABLE COPY

[11] 4,047,626

[45] Sept. 13, 1977

[54] CLAMSHELL BUCKET FOR WHEEL LOADER

[75] Inventor: Thomas C. Meisel, Jr., Phoenix, Ariz.

[73] Assignee: Caterpillar Tractor Co., Peoria, Ill.

[21] Appl. No.: 561,134

[22] Filed: Mar. 24, 1975

[51] Int. Cl.[2] ..... B65G 47/90

[52] U.S. Cl. ..... 214/147 G; 37/187; 172/276; 214/656; 294/70; 294/88

[58] Field of Search ..... 294/88, 106, 70; 214/147 R, 147 G, 656, 657, 15 C, DIG. 10, 650 R, 651-655; 37/187, 188; 172/276; 212/42, 44, 81, 84, 127, 42.5, 129

[56] References Cited

U.S. PATENT DOCUMENTS

| | | | |
|---|---|---|---|
| 443,993 | 1/1891 | Henry | 212/42.5 |
| 477,621 | 6/1892 | Bulmer | 212/42 |
| 2,949,201 | 8/1960 | MacAlpine et al. | 214/657 |
| 3,187,916 | 6/1965 | O'Leary | 294/70 X |
| 3,211,065 | 10/1962 | Hunger | 214/147 R X |
| 3,312,496 | 4/1967 | Boutelle et al. | 214/147 G X |
| 3,558,177 | 1/1971 | Snead | 294/70 |
| 3,693,274 | 9/1972 | Piccagii | 37/187 |
| 3,796,332 | 3/1974 | Kawamura | 294/88 X |

FOREIGN PATENT DOCUMENTS

| | | | |
|---|---|---|---|
| 278,668 | 2/1970 | Austria | 37/187 |
| 1,426,753 | 12/1965 | France | 214/653 |
| 903,555 | 2/1954 | Germany | 214/653 |
| 628,045 | 8/1949 | United Kingdom | 212/42 |

*Primary Examiner*—Frank E. Werner
*Attorney, Agent, or Firm*—Phillips, Moore, Weissenberger, Lempio & Majestic

[57] ABSTRACT

A loader vehicle includes a forwardly disposed bucket made up of a pair of jaws, with linkage means associated therewith so that, with the jaws in their open state such jaws are initially moved forwardly of the vehicle, and then subsequently the jaws are guided by such linkage means into a closing action.

8 Claims, 3 Drawing Figures

CLAMSHELL BUCKET FOR WHEEL LOADER

BACKGROUND OF THE INVENTION

This invention relates to loader vehicles, and more particularly, to a loader vehicle utilizing a clamshell bucket in association therewith.

In general, in conventional wheel loader bucket loading, the bucket in an open state is crowded or forced into a pile of material to be loaded by the tractive effort of the loader vehicle itself. Such a system is generally not without certain problems, since, in order to achieve such crowding of the bucket into the pile, a very high level of vehicle drive horsepower is required, and extremely rapid tire wear results during such operation.

Conventional front-mounted loader buckets have been modified in various ways to make them more versatile and productive. Even though ejectors and top clamps or closures such as shown in U.S. Pat. No. 3,523,621 to Anderson et al and U.S. Pat. No. 3,484,010 to Campbell (both assigned to the assignee of this invention) and U.S. Pat. No. 3,252,606 to Pryor have been adapted to conventional front-loader buckets, the specific problems set forth above continue to exist. In general, the major portion of all such vehicles continues to be loaded by means of the bucket being directly and forcefully engaged with the material to be moved.

U.S. Pat. No. 3,669,287 to Billings discloses a clamshell bucket equipped as part of a vehicle, which is quite large, costly and specialized, and not well adapted for the use described above. U.S. Pat. No. 3,693,274 to Piccagli discloses a clamshell bucket in which the jaws are initially pivoted inwardly to bite to an extent into a material, and are subsequently moved relatively away from a support frame, meanwhile continuing to be moved to a closed position. This is quite different from the present device, which will be described in detail.

SUMMARY OF THE INVENTION

It is accordingly an object of this invention to provide a vehicle which utilizes a clamshell bucket in which means are included for providing that the bucket is initially moved forwardly while still in an open position, and then subsequently closed to effectively bite into material.

It is a further object of this invention to provide a vehicle incorporating a clamshell bucket which, while fulfilling the above object, provides for effective, safe and efficient use thereof.

Broadly stated, the invention comprises a bucket assembly comprising a support frame, a bucket comprising first and second jaws, and means interconnecting the support frame and first and second jaws for providing that the jaws are movable from open to closed states, the means interconnecting the support frame and first and second jaws further providing that the open jaws are initially moved to an extent in a substantially open state relative to the support frame, and subsequently to said closed state.

BRIEF DESCRIPTION OF THE DRAWINGS

These and other objects of the invention will become apparent from the study of the following specification and drawings in which.

DESCRIPTION OF THE PREFERRED EMBODIMENT

Figure 1:
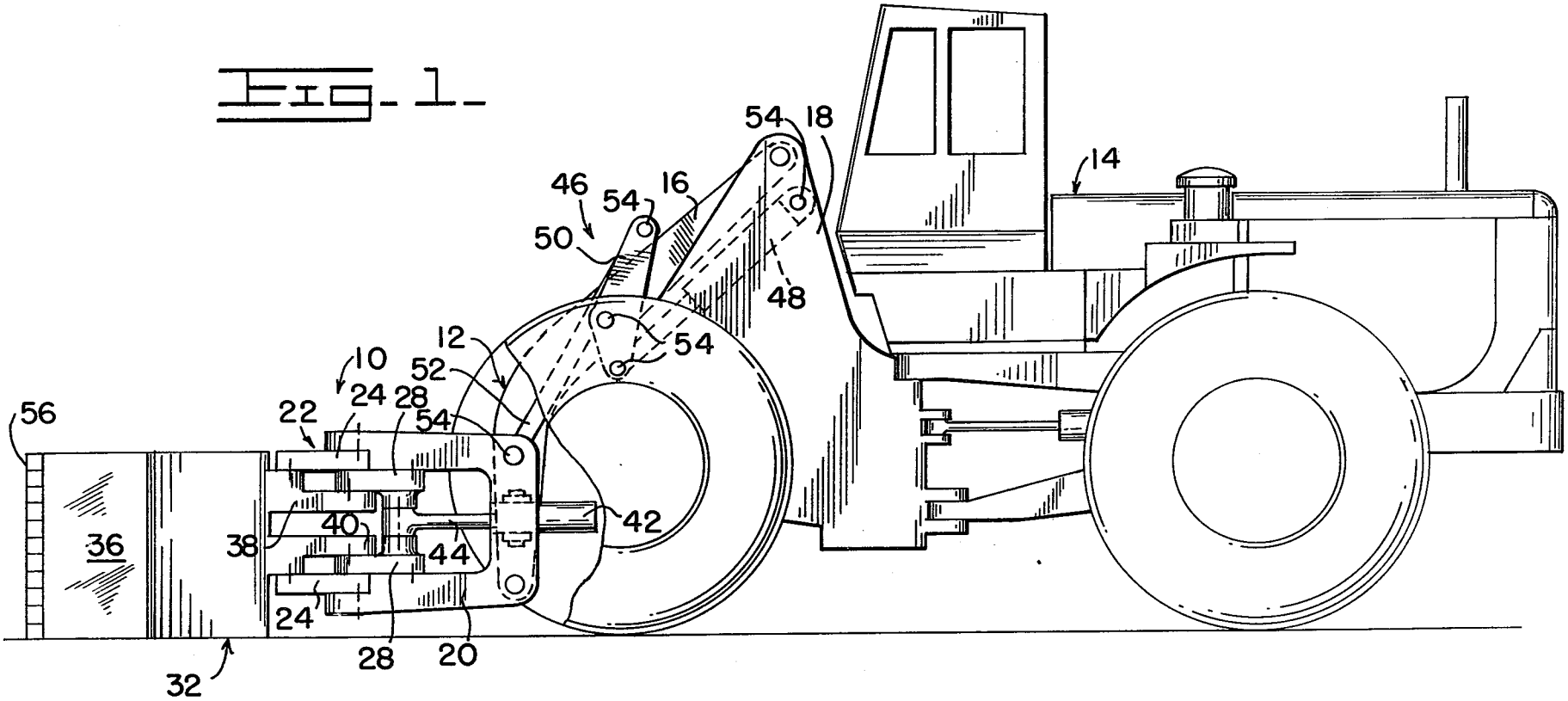
FIG. 1 illustrates a wheel-loader in side elevation with the subject invention attached to the front thereof.
Figure 2:
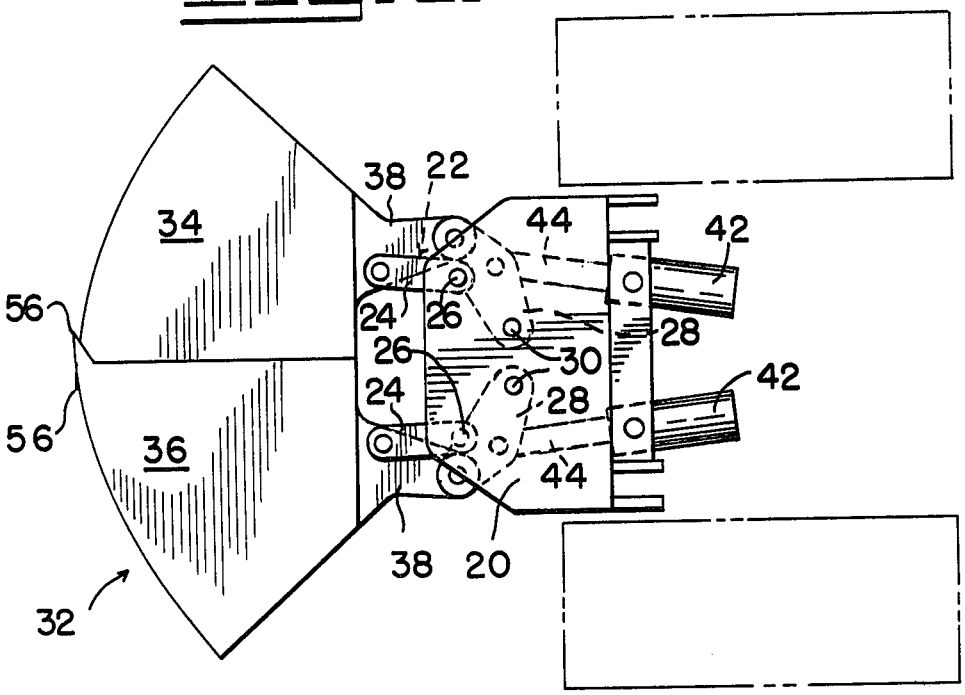
FIG. 2 is a plan view of the clamshell arrangement of the loader of FIG. 1 with the coacting jaws closed.
Figure 3:
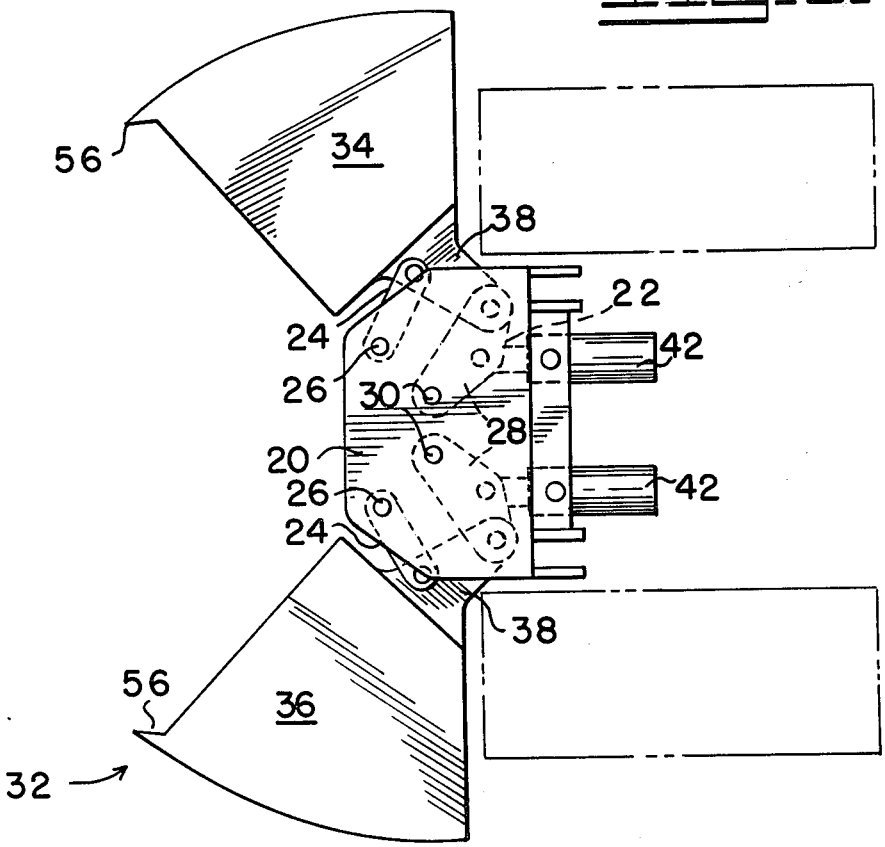
FIG. 3 is a view similar to that shown in FIG. 2, but with the jaws in their open state.

As shown in FIG. 1, a horizontally disposed clamshell bucket arrangement 10 is operatively attached to the forward end of a loader linkage 12 mounted on a wheeled vehicle 14. The loader linkage 12 includes a pair of spaced, obliquely disposed lift arms 16 pivotally attached to the vehicle frame 18, and extending forwardly therefrom. Pivotally fixed to the extended ends of the lift arms 16 is a support frame in the form of a bracket 20. The support frame 20 is generally U-shaped in cross section, and linkage means 22 are pivotally associated with such support frame 20 as best shown in FIGS. 2 and 3. A pair of link members 24 are pivotally fixed to the upper portion of the support frame 20 at their inward ends, as shown at 26. Another pair of link members 28 are pivotally fixed to the upper portion of the support frame 20 at their inward ends, as shown at 30. The pivots 26 are positioned forwardly and outwardly of the pivots 30, and the links 24 are somewhat shorter in length than the links 28. It is to be understood that identical links are associated with the lower portion of the support frame 20 in the same manner.

The bucket 32 is made up of jaws 34,36, and each jaw has fixed thereto a pair of support legs 38,40, which are together in general disposed closer to the upper surface of the respective jaw than the lower surface thereof. Each upper support leg 38 has its extended end pivotally fixed to the extended end of an upper link 28, and the extended end of an upper link 24 is pivotally fixed to the support leg 38 inward of the extended end of such respective support leg 38 (in the direction of the respective jaw). It will again be understood that the lower support legs 40 of the jaws 34,36 are associated with the lower links 24,28 in a like manner.

The linkage means 22 and support legs 38,40 make up means which interconnect the support frame 20 and to jaws 34,36, so that the jaws 34,36 move in a manner which will be described in detail. Cylinders or jacks 42 are pivotally mounted to the support frame 20, and have their rod ends 44 extending to adjacent the links 28 as shown, and are pivotally connected at such rod ends 44 to the links 28 at substantially the mid-points thereof.

A closely associated complimenting tilt linkage 46 is included, consisting of a pair of fluid jacks 48, levers 50, and connecting rods 52, which are pivotally attached at 54 to each other and to frame 18, lift arms 16 and support frames 20. Through actuation of the jacks 48, the tilt linkage 46 may be utilized to selectively tilt and position the support frame 20 relative to the lift arms 16, for providing tilt correction as lift arms 16 are elevated by appropriate hydraulic jack means (not shown).

In operation, the vehicle 14 carries jaws 34,36, fully open as shown in FIG. 3, into contact with material to be moved. In such state, the jacks 42 and links 24,28 are in their fully retracted state. The jaws 34,36 include teeth 56 which are brought into engagement with the material to be moved, and the vehicle brakes are set. The jacks 42 are actuated to extend, pivoting the links 24,28 so that the open jaws 34,36 are initially moved to an extent away from and forwardly of the vehicle 14 in a substantially open state, such positioning of jaws 34,36 being determined by the placement of the links 24,28 as described above. Further extension of the jacks 42 results in the jaws 34,36 being moved generally laterally of the vehicle 14 from such open to the closed state thereof, subsequent to such initial movement of the substantially open jaws 34,36. The specific positions of the different length links 24,28 functions as a distorting parallelogram to initiate first a forward crowding action into the material, then subsequently a simple clamshell closing of the jaws 34,36. The forceful biting motion afforded by the links 24,28 assures effective positive bucket loading above or below ground level.

It will be understood that addition of an ejector mechanism, such as disclosed in U.S. Pat. No. 3,484,010, and U.S. Pat. No. 3,523,621, (both assigned to the assignee of this invention) would further assure minimum load/-dump cycle time for all types of materials.

It will be seen that the particular arrangement of lift arms 16 and tilt linkage 46 allows flat loading of the bucket 32 at substantially any height of a pile of material, and if desired, at any angle the tilt linkage 46 can attain. This permits, for example, the biting of the top of the pile, or the loading below grade to form a ramp or hole. It will also be seen that this arrangement need not be limited to front end loader vehicles. The particular action described above would be extremely useful for general clamshell bucket applications. The ability of the arrangement to load unusual materials is readily seen. Large bulky items can simply be clamped between the jaws 34,36 and loaded.

What is claimed is:

1. A bucket assembly comprising:

a support frame;

a bucket comprising first and second jaws; first link means comprising a first pair of links, each pivotally connected to the support frame and first jaw;

second link means comprising a second pair of links, each pivotally connected to the support frame and second jaw;

each link being movable without direct connection to any other link;

the first and second pairs of links providing that the jaws are movable to open and closed states, said first and second pairs of links further providing that the open jaws are initially moved to an extent in a substantially open state with a generally rectilinear motion relative to the support frame and subsequently with a generally arcuate motion relative to the support frame to said closed state; and motion means pivotally mounted to the support frame and pivotally mounted to a link or a jaw for so moving the first and second jaws.

2. The assembly of claim 1 and comprising a vehicle with which the support frame is associated, and wherein the link means are positioned so that the open jaws are initially moved to an extent in a substantially open state away from the vehicle.

3. The assembly of claim 2 wherein the open jaws are initially moved to an extent in a substantially open state forwardly of the vehicle.

4. The assembly of claim 3 wherein the jaws move generally laterally of the vehicle from said open to said closed state.

5. A bucket assembly comprising: a support frame; a bucket comprising first and second jaws; and means interconnecting the support frame and first and second jaws for providing that the jaws are movable from open to closed states, said means interconnecting the support frame and first and second jaws further providing that the open jaws are initially moved to an extent in a substantially open state with a generally linear motion relative to the support frame, and subsequently with a generally arcuate motion relative to the support frame to said closed state, wherein the means interconnecting the support means and jaws comprise link means and comprising a vehicle with which the support frame is associated, and wherein the link means are positioned so that the open jaws are initially moved to an extent in a substantially open state away from and forwardly of the vehicle, wherein the jaws move generally laterally of the vehicle from said open to said closed state, wherein the jaws define upper and lower surfaces and wherein the means interconnecting the support frame and jaws further comprise support legs fixed to the jaws and disposed generally closer to the upper surfaces of the jaws than the lower surfaces thereof.

6. The assembly of claim 5 and further comprising means for moving the jaws from said open to said closed state, comprising jack means interconnecting the support frame and link means.

7. The assembly of claim 1 and further comprising a vehicle having a vehicle frame, and further comprising lift arms pivotally fixed to the vehicle frame, the support frame being pivotally fixed to the extended ends of the lift arms.

8. The assembly of claim 7 and further comprising tilt linkage means associated with the vehicle frame, lift arms, and support frame for selectively tilting and positioning the support frame relative to the lift arms.

* * * * *